United States Patent [19]

Franek

[11] 4,301,595

[45] Nov. 24, 1981

[54] CAN OPENER

[75] Inventor: Jozef T. Franek, Chorley Wood, England

[73] Assignee: Metal Box Limited, Reading, England

[21] Appl. No.: 147,628

[22] Filed: May 7, 1980

[30] Foreign Application Priority Data

Jun. 14, 1979 [GB] United Kingdom ..... 20818/79

[51] Int. Cl.[3] ..... B67B 7/34

[52] U.S. Cl. ..... 30/427

[58] Field of Search ..... 30/424–427

[56] References Cited

U.S. PATENT DOCUMENTS

| | | | |
|---|---|---|---|
| 1,986,870 | 1/1935 | West | 30/427 |
| 1,999,370 | 4/1935 | Olschewski | 30/426 |
| 2,119,135 | 5/1938 | Link | 30/426 X |
| 2,595,162 | 4/1952 | Nessler | 30/424 |
| 2,715,265 | 8/1955 | Hult | 30/426 X |

FOREIGN PATENT DOCUMENTS

| | | | |
|---|---|---|---|
| 627957 | 8/1949 | United Kingdom | 30/426 |

*Primary Examiner*—Gary L. Smith

*Attorney, Agent, or Firm*—Diller, Ramik & Wight

[57] ABSTRACT

A can opener (10) has a cutter roll (40) for cutting an outer seam wall (49) of a double end seam (41) securing a can end (43) to a can body (45). A traction roll (20) of the opener (10) is engageable with the end seam (41) and is rotatable to drive the cutter roll (40) about the seam (41). An abutment (52) is provided to engage the end seam (41) to position the center ($O_c$) of the cutter roll (40) behind that ($O_T$) of the traction roll (20) in the direction of movement of the opener (10). The two rolls (20,40) have skew axes so that in use the cutter roll (40) cuts into the outer seam wall (49) ahead of a plane ($P_1$) through the traction roll axis and the cutter roll center ($O_c$), and so that a generator (51) of the cutter roll's curved surface (48) is inclined where the cutter roll (40) contacts the outer seam wall (49) from the cutting edge (50) towards a plane ($P_5$) containing the top (47).

10 Claims, 7 Drawing Figures

CAN OPENER

This invention concerns can openers of the kind designed to cut through the outer seam wall of a double end seam by which a can end is secured to a can body.

Can openers of this kind have been available for some years or have already been proposed and one such opener is disclosed in U.K. Pat. Specification Nos. 1,175,575 and 1,301,592 and comprises, in general:

(a) a cutter wheel;

(b) a traction roll having a chuck wall engaging surface and having a peripheral surface disposed parallel to the roll axis for engaging a curved portion connecting the outer seam and chuck walls of the can end seam, the axes of the cutter wheel and the traction roll lying in the same plane either at right angles or at an acute angle relative to one another;

(c) a housing carrying the cutter wheel and traction roll, the cutter wheel being contained within a recess in the housing;

(d) means for rotating either the cutter wheel and/or the traction roll;

(e) an abutment arranged to engage the top of the can end seam so as to determine the positioning of the cutter wheel relative to the traction roll in a can opening operation whereby to achieve a given cutting angle (which can be defined as the angle between a first plane containing the top of the can end seam and a second plane parallel to the traction roll axis and containing a tangent to the cutting edge of the cutter at the leading point of contact between the cutting edge and the can end seam); and (f) means, such as a cam, for moving the roll axially to facilitate initial location of the opener on the can end seam.

The above can opener suffers from a number of disadvantages. For example, when the axes of the cutter wheel and traction roll are perpendicular, the space available for the bearings of one of these is confined and resultant bearing wear tends to impair the cutting action of the cutter wheel. Also, access to the cutter wheel for cleaning purposes is hampered by the location of the wheel inside a recess in the housing.

Broadly, the present invention provides a can opener having a cutter roll, a traction roll arranged relative to the cutter roll so that a chuck wall engaging surface and a peripheral surface of the traction roll are engageable respectively with the chuck wall of a double end seam by which a can end is secured to a can body and with a curved portion connecting the outer seam and chuck walls of the can end seam while the cutter roll acts on the outer seam wall, means associated with one of the two rolls to effect rotation thereof, and an abutment disposed on the opener to engage the can end during a can opening operation so as to position the centre of the cutter roll behind the centre of the traction roll in the direction of movement of the opener, the axes of the two rolls being arranged relative to one another such that a cutting edge of the cutter cuts into the outer seam wall in a can opening operation in advance of a plane defined by the axis of the traction roll and the centre of the cutter roll, and such that a generator of the curved peripheral surface of the cutter roll is inclined, in the region where the cutter roll contacts the outer seam wall, from the cutting edge towards a plane containing the top of the can end seam.

By virtue of this arrangement of the two axes, cutting of the outer seam wall occurs ahead of the narrowest region between the two rolls and, after cutting, the cut edge of the can end is crimped and curled inwardly. As a result a jagged edge formed on the can end by the cutting action is turned inwardly and is not left exposed.

In a preferred form of the invention, the axes of the two rolls are skew relative to one another, the curved peripheral surface of the cutter roll being generally cylindrical. This arrangement provides increased length for the bearings of at least one of the two rolls, as compared with the earlier opener wherein the axis of the cutter wheel is perpendicular to that of the traction roll, because the axes do not intersect so that spindles carrying the rolls may be longer without interfering with each other. An additional advantage given by this arrangement is that the cam of the prior opener may be omitted whereby a simplified construction is possible. This is because the can opener is capable of automatically locating itself on the can end seam at the commencement of a can opening operation: as a result of the skew arrangement of the two roll axes, when the chuck wall engaging surface of the traction roll and the cutting edge of the cutter roll are pressed downward into initial contact with the can end seam and one roll is rotated in its forward direction, the centre of the cutter roll rotates about the initial point of contact of the cutting edge with the outer seam wall and so moves away from the can end until such motion is stopped by engagement of the peripheral surface of the traction roll with the top of the can end seam. The can opener is then in its correct operating condition, providing that the abutment is contacting the can end.

Conveniently the relative arrangement of the two rolls in the operating condition of the opener may be defined by:

(i) the angle between a plane containing the traction roll axis and the centre of the cutter roll and a plane through the axis of the can and the traction roll axis, thus angle being referred to as the trail angle;

(ii) the angle between a first plane through the traction roll axis parallel to the top of the end seam of the can and a second plane through the cutter roll axis parallel to a radius of the traction roll in the first plane, this angle being referred to as the cutter incline angle; and (iii) the angle between a plane through the traction roll axis and the axis of the can and a plane through the cutter roll axis parallel to the axis of the can, this angle being referred to as the cutter offset angle.

A preferred range for the cutter incline angle is 10° to 30° whilst the cutter offset angle preferably lies in the range of 0° to 10°. The trail angle may advantageously be approximately 16°. Such angles permit an opener construction wherein the cutting force presented by the cutter roll has a relatively small component in a direction parallel to the axis of the traction roll by comparison with the prior can opener mentioned above. Thus the separating force urging the two rolls apart during a can opening operation is relatively small so that a low spring force acting on the traction roll to bias it towards the cutting edge of the cutting roll would be sufficient to enable the opener to accommodate varying thicknesses of can end seam.

One embodiment of the invention features a cutter roll mounted externally of an exposed face of a housing carrying the two rolls. This has the advantage of facilitating cleaning of the cutter roll and is rendered possible by the relative arrangement of the two rolls.

The cutter roll may have a serrated cutting edge to improve the cutting action of the opener. This enhances the frictional engagement between the cutter roll and the outer seam wall so that the cutter roll is urged to rotate as the can opener moves about the can end seam. Alternatively or in addition, the cutter roll may be coupled with the traction roll by a gear arrangement to ensure that both rolls are positively driven during cutting, and thus to improve the cutting action by inhibiting skidding of either roll.

The invention is described further, by way of example, with reference to the accompanying drawings, wherein.

Figure 1:
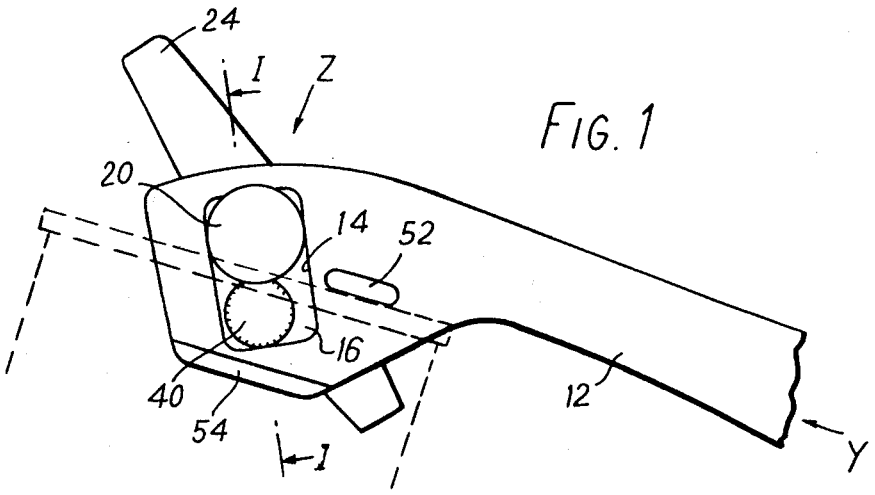
FIG. 1 is a side view of a can opener embodying the invention.

Referring to the drawings, a can opener 10 has a stock 12 through which passes an opening 14. Into the opening 14 is fitted a cartridge 16 carrying a traction roll spindle 18. A traction roll 20 is fixed to an end of the spindle 18 at one side of the stock 12 and at an opposite side of the stock 12 an extension 22 of the spindle 18 is joined to a butterfly handle 24 by a pin 26. The spindle 18 is slidable within the cartridge 16 to permit axial movement of the traction roll 20 and is resiliently urged to the right in FIG. 2 by the action of a spring 28, housed in an annular space 30 in the butterfly handle 24, on a thrust washer 32. The washer 32 has a plurality of recesses 34 within which engage tongues 36 protruding axially from the hub of the handle 24 so that the washer is enabled to move axially relative to the handle 24 but rotates with the handle when this is turned. This washer 32 bears against the cartridge 16 and stock 12.

Figure 2:
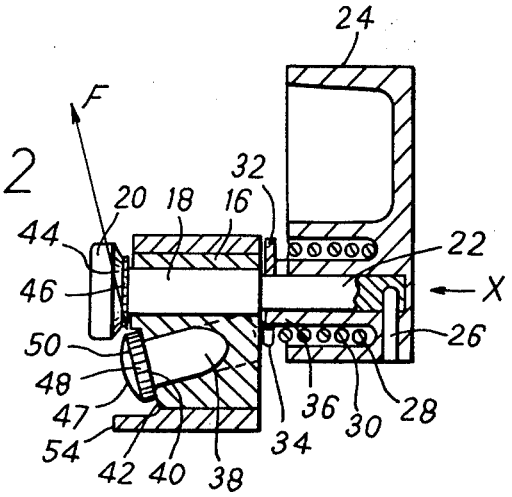
FIG. 2 is a partial section through the opener along the line I—I in FIG. 1.
Figure 6:
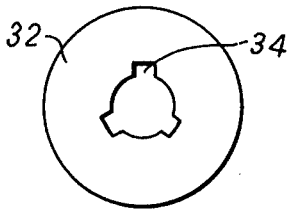
FIG. 6 is an enlarged plan view of a washer of the can opener.

As shown in FIG. 2, the cartridge 16 also carries a cutter roll spindle 38 whose axis is skew relative to the axis of the traction roll spindle 18. At one end of the spindle 38 there is fixed a cutter roll 40 so as to lie externally of an exposed face 42 of the cartridge 16.

The traction roll 20 has a ribbed frusto-conical surface 44 for engaging a chuck wall 39 of a double end seam 41 securing a can end 43 to a can body 45 and also has a ribbed axially extending peripheral surface 46 for engaging the top 47 of the end seam, i.e. a curved portion connecting the outer seam wall 49 and the chuck wall of the end seam. The cutter roll 40 has a generally cylindrical curved surface 48 which is serrated and which terminates at its end remote from the spindle 38 in a cutting edge 50. A portion of the cutting edge 50 extends behind the surface 44 of the roll 20 as shown in FIG. 1 and this prevents the spindle 38 from sliding out of its bore in the cartridge 16.

Two abutments 52, 54 are provided on the stock 12 to ensure that during a can opening operation the two rolls take up a predetermined position relative to the can. The abutment 52 comprises a fin projecting from the stock 12 parallel to the axis of the roll 20 to engage the top 47 of the can end seam 41 so as to ensure that the centre $0_c$ of the cutter roll is behind the centre $0_T$ of the traction roll in the direction of movement of the opener about the can. The fin 52 is wide enough to engage both cans of larger and cans of smaller diameter. And the abutment 54 is arranged to engage the side wall of the can body.

Figure 3:
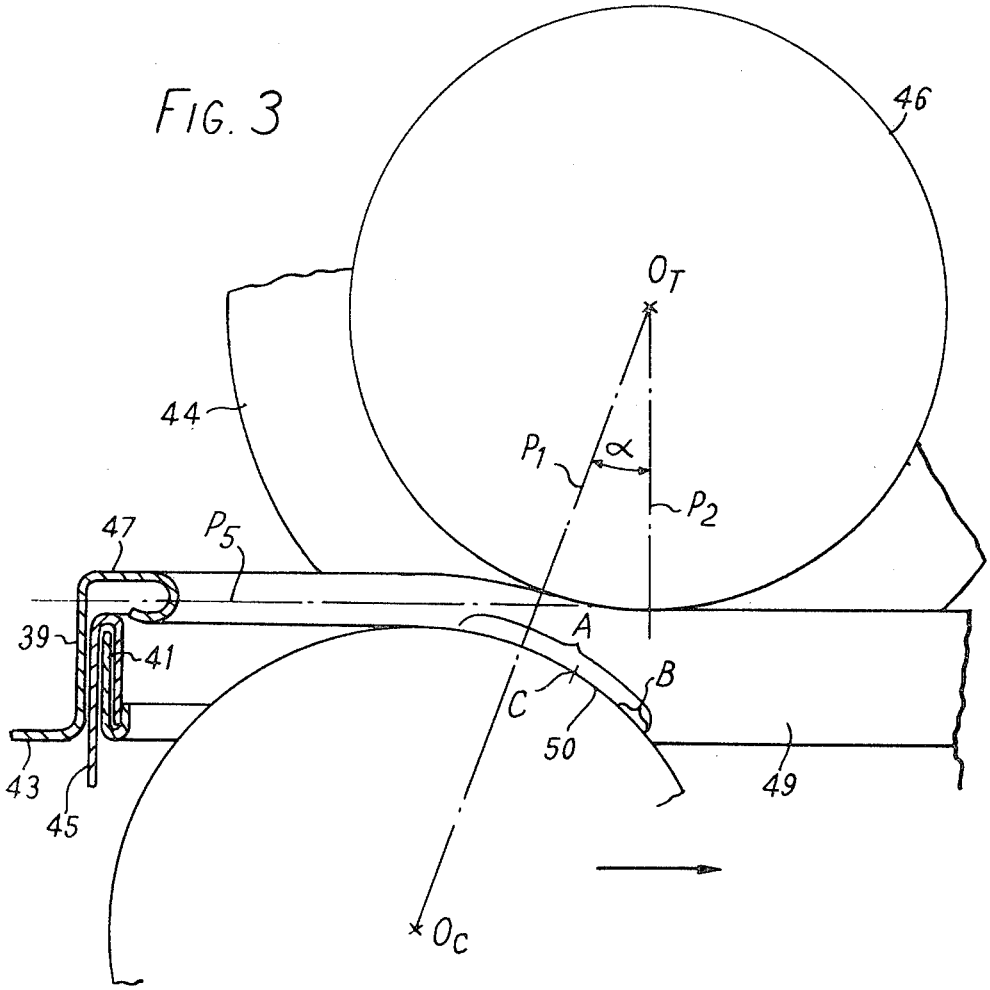
FIG. 3 is a diagrammatic view of a traction roll of the opener and a cutting edge of a cutter roll of the opener looking in the direction of the arrow X in FIG. 2 during a can opening operation.

The relative positioning of the two rolls which characterises the invention is best understood by considering the can opener in the course of a can opening operation. FIG. 3 shows how the centre of the cutter roll trails the centre of the traction roll when the fin 52 travels along the top of the can end seam. The trail angle $\alpha$ thus formed between a plane P1, through the traction roll axis and the centre of the cutter roll, and a plane P2 through the traction roll axis and the axis of the can is in the present instance approximately 16°. In the drawings these planes extend perpendicular to the plane of the page, as do also the planes mentioned below.

Figure 4:
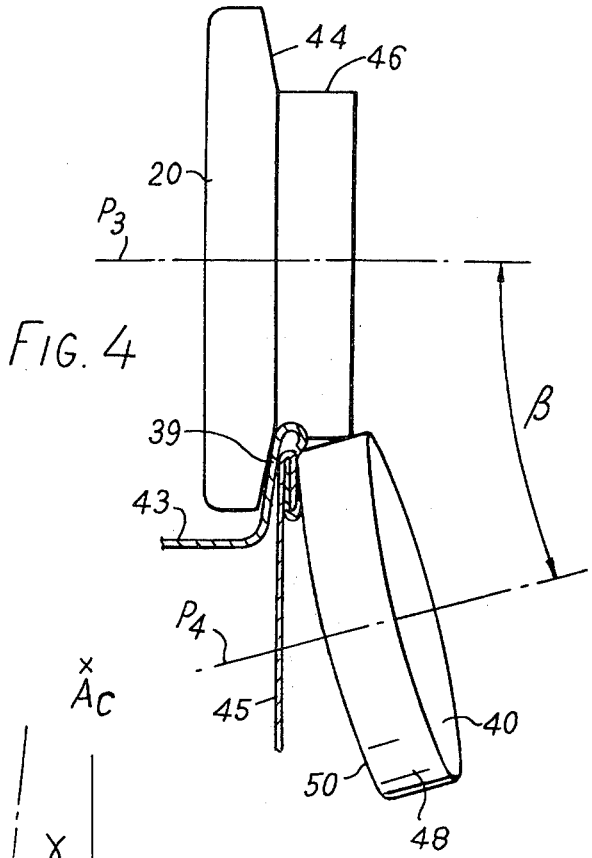
FIG. 4 is a diagrammatic view of the two rolls looking in the direction of the arrow Y in FIG. 1 during a can opening operation.

Turning to FIG. 4 it is seen that during cutting the axis of the cutter roll is inclined relative to a plane P3 through the traction roll axis parallel to the top of the can end seam. The cutter incline angle $\beta$ between this plane P3 and plane P4 through the cutter roll axis parallel to a radius of the traction roll lying in the plane P3 is 15°. This is not essential, however, and the cutter incline angle may vary, preferably within the range 10° to 30°. The effect of inclining the cutter roll axis in this manner is that an upper region of the cutting edge cuts into the outer seam wall of the end seam 41; and that a generator 51 of the curved peripheral surface 48 of the cutter roll is upwardly inclined from the cutting edge 50 towards a plane P5 containing the top of the can end seam, at least in the region where the cutter roll contacts the outer seam wall (shown as the region marked A in FIG. 3). Furthermore, the positioning of the cutter roll relative to the frusto-conical surface 44 of the traction roll is such that its cutting edge cuts into the outer seam wall in advance of the plane P1 defined by the axis of the traction roll and the centre of the cutter roll (see region B in FIG. 3).

Figure 5:
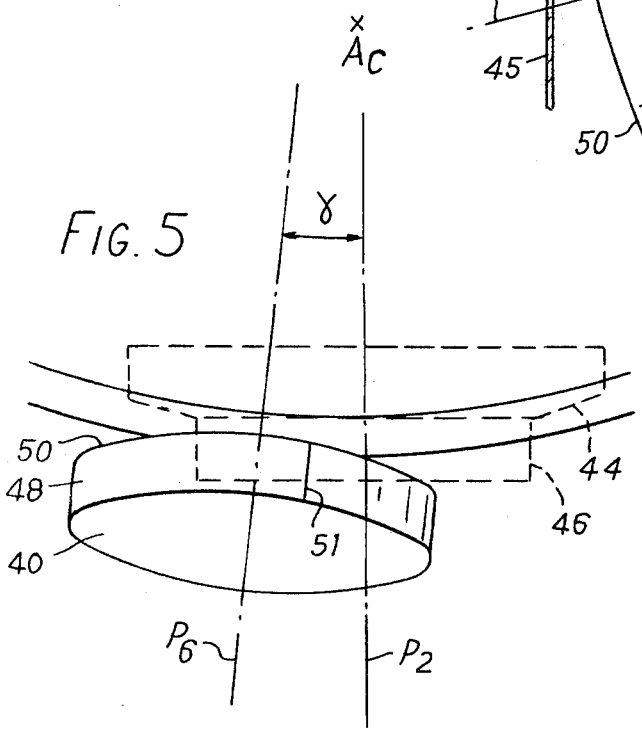
FIG. 5 is a diagrammatic view of the cutter roll looking in the direction of the arrow Z in FIG. 1 during a can opening operation, the traction roll being shown in dashed lines.

In the embodiment illustrated, the axis of the cutter roll is also offset (FIG. 5) relative to the plane P2 through the traction roll axis and the axis of the can. The offset angle $\gamma$ thus formed between the plane P2 and a plane P6 through the cutter roll axis parallel to the axis of the can is 6°. Again, however, the offset angle may vary, preferably within the range 0° to 10°. With the offset angle in this range, the axis of the cutter roll does not intersect the axis of the can, for most standard sizes of can, but rather intersects the plane P2 on the side of the can's axis remote from the traction roll.

By arranging the two rolls as described, the cutting edge of the cutter roll cuts into the outer seam wall of the can end seam at the region B in FIG. 3 ahead of the narrowest region between the two rolls. The narrowing of the gap between the two rolls then causes the upper portion of the cut seam wall to be crimped. The slope provided by the generator of the curved peripheral surface of the cutter roll, and hence by the region A of the curved peripheral surface in the direction of the cutter roll's axis, relative to the plane P5 containing the top of the can end seam causes this portion to be curled inwardly during crimping to conceal any jagged edges produced by cutting. In addition, the curled edge is lifted as it passes over the topmost region of the cutter roll.

In order to commence a can opening operation, the frusto-conical surface of the traction roll is pressed down into engagement with the chuck wall of the can end seam and say a point C of the cutting edge of the cutter roll is pressed into contact with the outer seam wall. The frusto-conical surface, being ribbed, and the cutting edge, being serrated, friction-ally engage the chuck and outer seam walls and this, coupled with the skew arrangement of the two rolls, ensures that rotation of the traction roll as for forward movement of the can opener causes the centre of the cutter roll to rotate about the point C. As a result, the centre of the cutter roll moves downwardly away from the can end forcing the traction roll downwardly until its peripheral surface engages the top of the can end seam, and the cutting edge bites into the outer seam wall.

Returning to FIG. 2 it may be seen that the resultant direction of the cutting force of the cutter roll is that indicated by the arrow F so that this force has only a relatively small component parallel to the axis of the traction roll 20. As a result the tendency of the two rolls to separate during a can opening operation is not great and the force of the spring 28 can be selected accordingly. The spring 28 may thus be weaker than was possible with the prior opener mentioned previously and the present opener is therefore more easily adaptable for use with cans of different seam thickness. Wear of the two rolls may also be lessened in that cutting of a can end seam is possible with a less tight grip on the can seam and for the same reason the torque which must be applied to the handle 24 during a can opening operation may be reduced.

Figure 7:
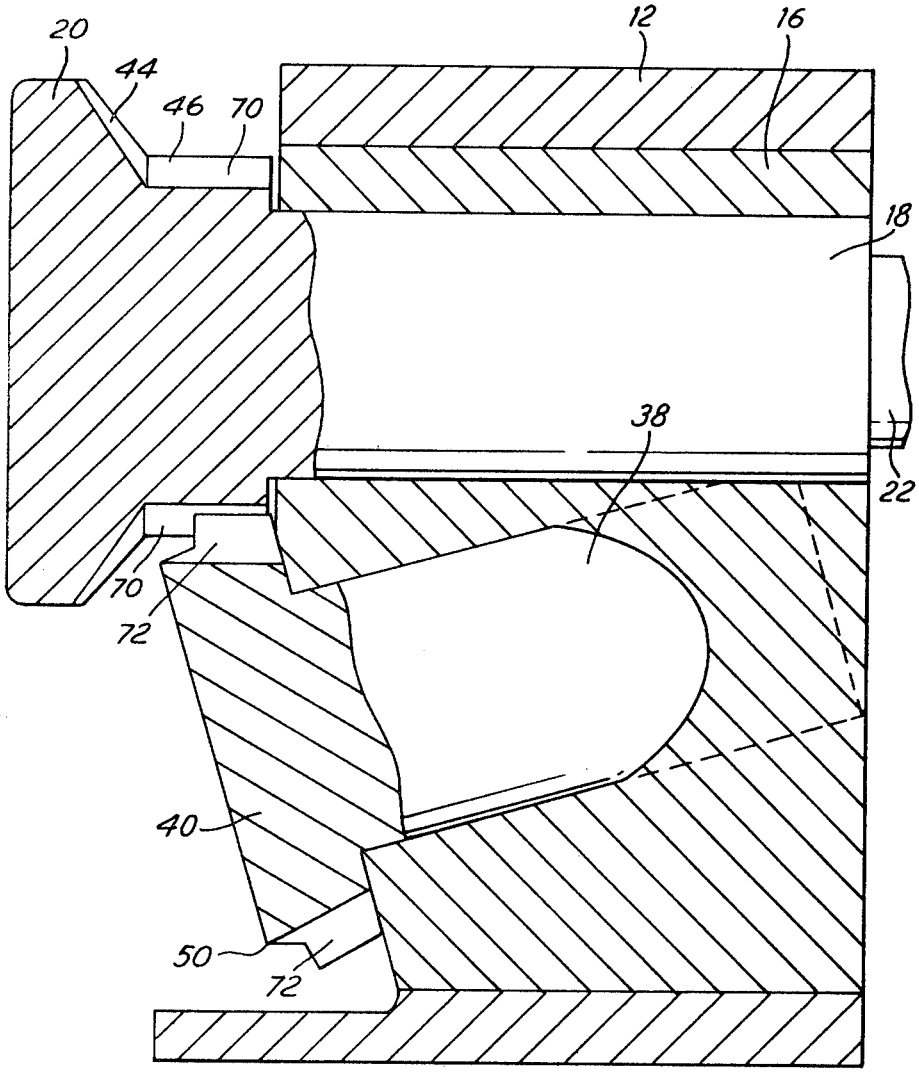
FIG. 7 is an enlarged section, corresponding with FIG. 2, of a modification of the can opener.

A modification of the can opener is shown in FIG. 7, which is a view similar to that of FIG. 2. Like parts are indicated by the same reference numerals. In this version of the opener, the ribbed surface 46 of the traction roll 20 is adapted to provide teeth 70 for engaging not only the top 47 of the end seam but also teeth 72 formed on the cutter roll 40. The teeth 72 have a frusto-conical pitch surface to enable them to mesh with the teeth 70 and are cut away adjacent the free end of the cutter roll 40 to provide the cutting edge 50.

As a result of this gear arrangement coupling the cutter roll 40 with the traction roll 20, the cutter roll 40 is positively driven during a cutting operation and skidding of either roll is inhibited which improves the cutting action.

I claim:

1. A can opener comprising a body, a cutter roll having a curved peripheral surface terminating in a circumferential cutting edge for engaging a circumferential outer wall of the double end seam of a can, an abutment projecting from one side of the body to engage on the top of the can seam, a traction roll having a peripheral surface for engaging on the top of said can seam, and means for rotating one of said rolls about its own axis, the abutment and said peripheral surface of the traction roll being tangent to a common first plane and the cutter roll being on the opposite side of said first plane from the traction roll, the traction roll further having a chuck wall engaging surface for engaging a chuck wall of the said can seam, the axis of the traction roll defining the intersection between a second plane parallel to said first plane and a third plane perpendicular to said first plane, said third plane being radial with respect to the can, the axis of the cutter roll defining the intersection between a fourth plane and a fifth plane, said fourth plane being perpendicular to said third plane and divergent from said second plane outwardly from said side of the body, a cutter incline angle in the range ten degrees to thirty degrees being defined between said second and fourth planes, said fifth plane being perpendicular to said first plane and convergent towards said third plane outwardly from said side of the body, and a cutter offset angle greater than zero being defined between said third and fifth planes, the curved peripheral surface of the cutter roll being such that a generator thereof is inclined, in the region where the cutting edge contacts the outer wall of the seam, from the cutting edge towards said first plane, whereby when the abutment and traction roll are engaged on the top of said can seam and the cutting edge with said outer wall thereof, and a said roll is rotated to effect relative circumferential movement between the opener and the can such that the centre of the cutter roll is behind the centre of the traction roll in the direction of relative movement of the opener, the cutting edge engages the can seam outer wall at an angle thereto substantially equal to the cutter incline angle to sever the outer wall with a cutting force having a substantially minor radial component and the outer peripheral surface of the cutter roll lifts and peels radially inwardly the served edge of the seam.

2. An opener as claimed in claim 1 wherein the curved peripheral surface of the cutter roll is generally cylindrical.

3. An opener as claimed in claim 1 wherein the cutter incline angle is fifteen degrees.

4. An opener as claimed in claim 1 wherein the cutter offset angle is no greater than ten degrees.

5. An opener as claimed in claim 1 wherein the traction roll and the cutter roll are arranged so that in a can opening operation a trail angle of approximately 16° is defined between a sixth plane, containing the traction roll axis and the centre of the cutter roll, and said third plane through the axis of the can and the traction roll axis.

6. An opener as claimed in claim 1 wherein the cutter roll has indentations in its cutting edge.

7. An opener as claimed in claim 6 wherein the cutting edge is serrated.

8. An opener as claimed in claim 1 wherein the abutment comprises a fin.

9. An opener as claimed in claim 1 wherein the cutter roll is coupled to the traction roll by means of a gear arrangement.

10. An opener as claimed in claim 9 wherein the cutter roll is provided with teeth which mesh with teeth on the traction roll.

* * * * *